US008657614B2

(12) United States Patent
Sun

(10) Patent No.: US 8,657,614 B2
(45) Date of Patent: Feb. 25, 2014

(54) ROTATING LAMP TUBE SOCKET STRUCTURE HAVING A SEAT BODY AND A COVER WITH A ROTATING ELEMENT

(75) Inventor: Ming-Hai Sun, Hsinchu (TW)

(73) Assignee: Chuan He Co., Ltd., Hsinchu (TW)

( * ) Notice: Subject to any disclaimer, the term of this patent is extended or adjusted under 35 U.S.C. 154(b) by 46 days.

(21) Appl. No.: 13/543,862

(22) Filed: Jul. 8, 2012

(65) Prior Publication Data

US 2013/0157492 A1 Jun. 20, 2013

(30) Foreign Application Priority Data

Dec. 20, 2011 (TW) ..... 100147249 A

(51) Int. Cl.
*H01R 33/02* (2006.01)

(52) U.S. Cl.
USPC ..... 439/233

(58) Field of Classification Search
USPC ..... 439/226–244; 362/382
See application file for complete search history.

(56) References Cited

U.S. PATENT DOCUMENTS

| | | | | |
|---|---|---|---|---|
| 2,441,871 | A * | 5/1948 | Dansereau | 439/238 |
| 7,568,930 | B2 * | 8/2009 | Brand et al. | 439/234 |
| 8,333,602 | B2 * | 12/2012 | Galluccio et al. | 439/241 |
| 8,475,189 | B2 * | 7/2013 | Sun | 439/233 |
| 8,475,190 | B2 * | 7/2013 | Sun | 439/233 |
| 2013/0033880 | A1 * | 2/2013 | Sun | 362/382 |

* cited by examiner

*Primary Examiner* — Chandrika Prasad
(74) *Attorney, Agent, or Firm* — Muncy, Geissler, Olds & Lowe, P.C.

(57) ABSTRACT

A rotating lamp tube socket structure includes a seat body, a cover and a rotating element, and the rotating element is pivotally turned with respect to a cover to an installing position or a conducting position, such that when the rotating element is pivotally turned to the installing position, an elastic element is compressed to retract in a direction towards the cover, and when the rotating element is pivotally turned to the conducting position, an elastic resilience of the elastic element props the rotating element to be protruded towards the outside.

7 Claims, 9 Drawing Sheets

ROTATING LAMP TUBE SOCKET STRUCTURE HAVING A SEAT BODY AND A COVER WITH A ROTATING ELEMENT

FIELD OF THE INVENTION

The present invention relates to a lamp tube socket structure, more particularly to the rotating lamp tube socket structure.

BACKGROUND OF THE INVENTION

With reference to FIG. 9 for a conventional lamp tube socket, the conventional lamp tube comprises a hollow main body 91, an abutting element 92 installed in the main body 91 and propped by an elastic element 93 towards an external protrusion of the main body 91, an insert hole 94 outwardly formed on an end side of the abutting element 92, and an electrically conductive plate 95 installed in the abutting element 92 and communicated with the insert hole 94, so that a lamp tube terminal (not shown in the figure) can be plugged into the insert hole 94 of the abutting element 92 and the lamp tube terminal is coupled to the electrically conductive plate 95 to define a conducting state, and the abutting element 92 is propped by the elastic element 93 to abut against an edge of the lamp tube to produce an additional effect of clamping and positioning the lamp tube.

In a practical application of the aforementioned conventional lamp tube socket, the abutting element 92 is propped by the elastic element 93 and situated at a stretched state normally, so that when the lamp tube is installed, it is necessary to press the abutting element 92 to compress the elastic element 93 and force the abutting element 92 to be retracted before the lamp tube can be installed successfully. The installation not only involves a complicated procedure, but also requires users to press the abutting element 92 on one side and plug the lamp tube terminal into the insert hole 94 of the abutting element 92 on the other side. Obviously, the installation is relatively difficult.

Therefore, it is a main subject of the present invention to overcome the aforementioned problems of the conventional lamp tube socket.

SUMMARY OF THE INVENTION

In view of the drawbacks of the prior art, it is a primary objective of the present invention to provide a rotating lamp tube socket structure with the advantages of a quicker and simpler installation of a lamp tube, and a more secured positioning effect of the installed lamp tube.

To achieve the foregoing objective, the present invention provides a rotating lamp tube socket structure comprising: a seat body, having an installing portion and a containing portion, and the containing portion having a support pillar, and at least one stop portion formed at a top end of the support pillar and protruded outwardly; a cover, covered onto the containing portion of the seat body, and having a through hole formed on the cover and communicated with the containing portion, and an electrically conductive plate installed in the through hole; a rotating element, passed into the through hole of the cover, and pivotally turnable with respect to the cover to an installing position and a conducting position, and having an elastic element installed in the containing portion of the seat body and capable of pushing the rotating element outward, an embedding groove penetrating through both sides of the rotating element and provided for embedding a lamp tube terminal therein, a plugging hole formed in the embedding groove and provided for passing the support pillar, a positioning portion disposed on an inner periphery of the plugging hole and opposite to the stop portion of the support pillar, and an oblique guide plane formed on both sides of the positioning portion separately and coupled to the positioning portion; wherein, during the process of pivotally turning the rotating element to the installing position, the oblique guide plane of the rotating element is limited by the stop portion of the support pillar to force the rotating element to retract in a direction towards the cover gradually and compress the elastic element, and when the rotating element is pivotally turned to the installing position, the positioning portion of the rotating element and the stop portion of the support pillar are latched with each other to position the rotating element; and when the rotating element is pivotally turned to the conducting position, the latch between the positioning portion and the stop portion is released, and an elastic resilience of the elastic element drives the rotating element propped by the elastic element to be protruded to the outside.

DESCRIPTION OF THE PREFERRED EMBODIMENTS

Figure 1:
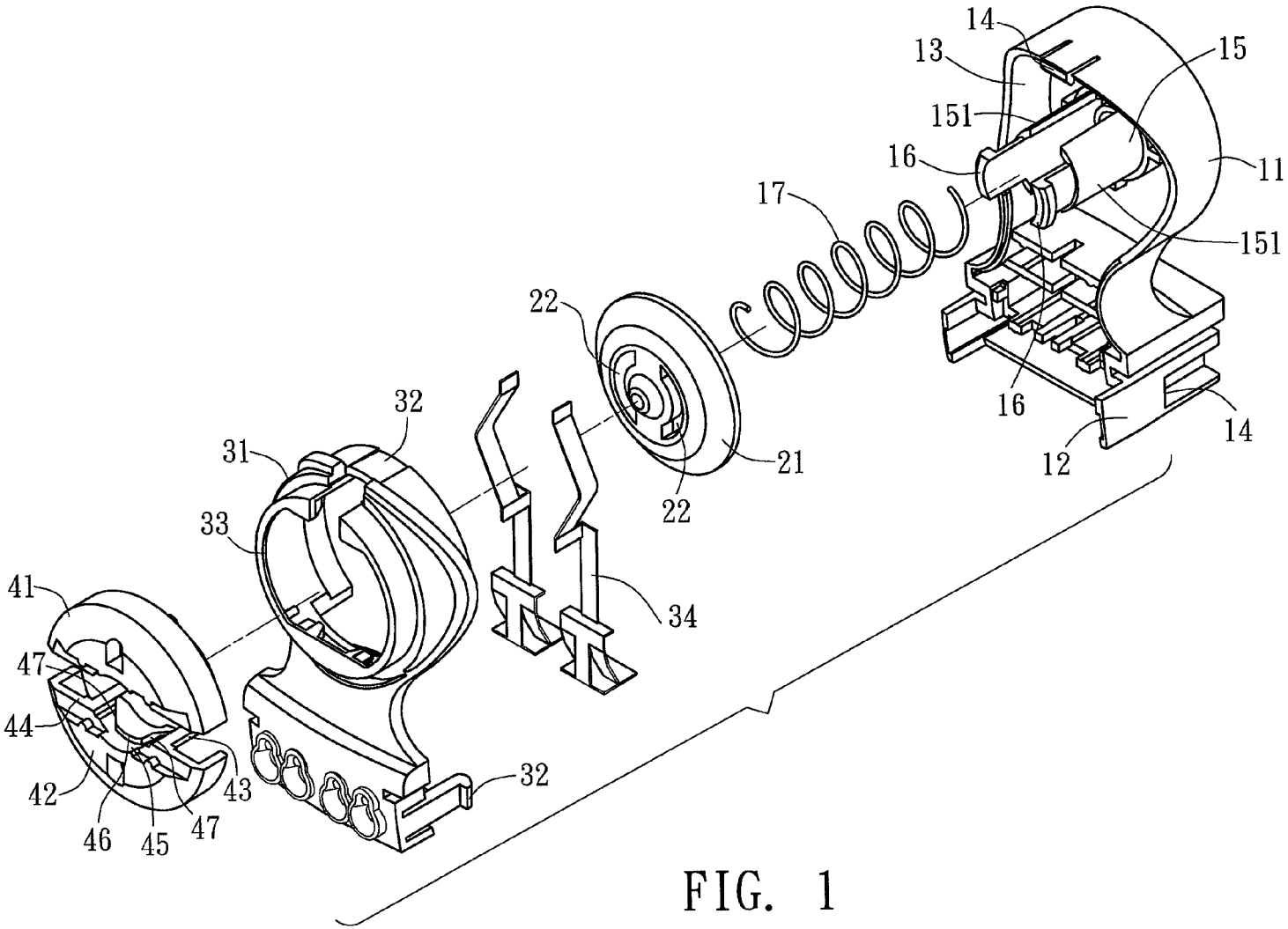
FIG. 1 is an exploded view of the present invention.
Figure 2:
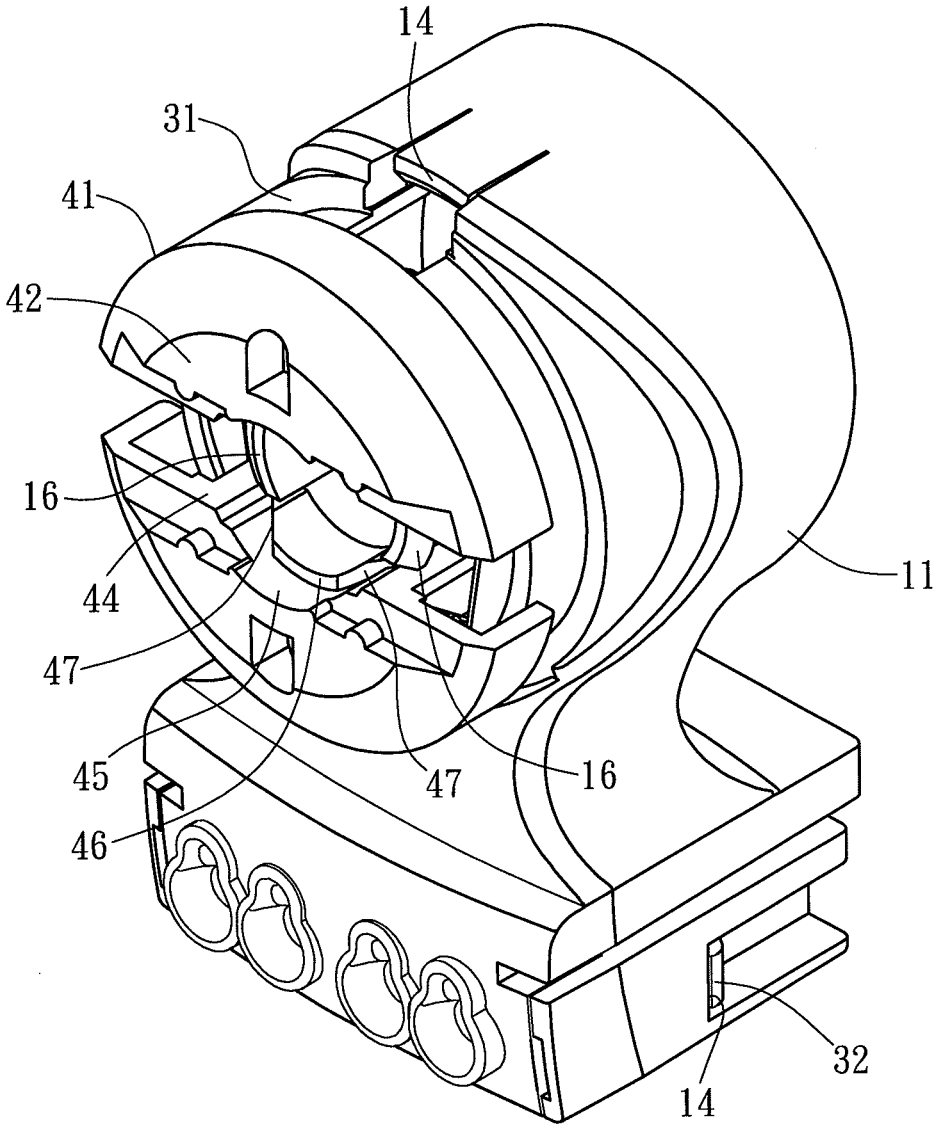
FIG. 2 is a perspective view of the present invention.
Figure 3:
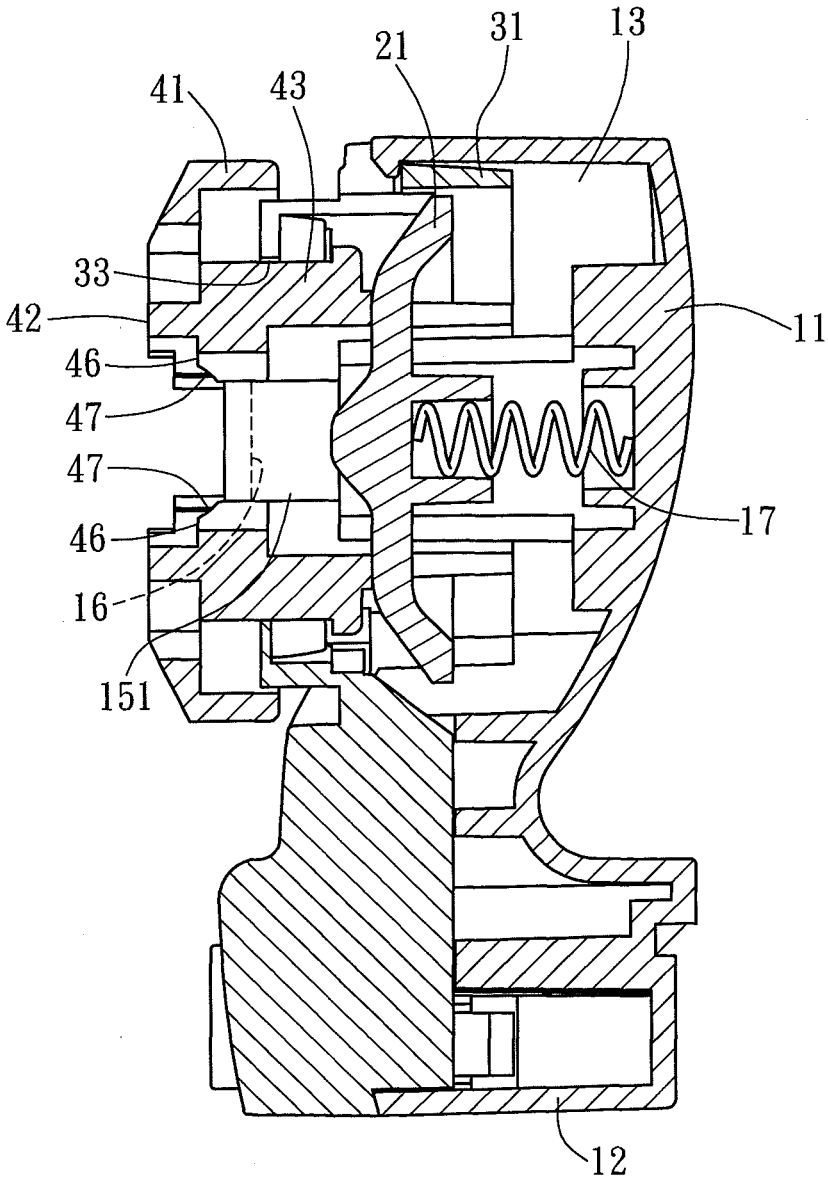
FIG. 3 is a cross-sectional view of the present invention.

With reference to FIGS. 1 to 8 for a rotating lamp tube socket structure of the present invention, the rotating lamp tube socket structure is provided for plugging a terminal 52 of a lamp tube 51 to define an electrically conducting state, and the rotating lamp tube socket structure comprises a seat body 11, a top support element 21, a cover 31 and a rotating element 41, wherein the seat body 11 has an installing portion 12 installed on a lamp tube base 61, and a containing portion 13 extended towards a direction opposite to the installing portion 12, and the seat body 11 has a first insert portion 14 disposed on both sides of the installing portion 12 and an outer side of the containing portion 13 separately, and a support pillar 15 is extended from the containing portion 13, and the support pillar 15 of this preferred embodiment is comprised of two wings 151 disposed opposite to each other, and each of the wings 151 has a stop portion 16 protruded outwardly from a top end of each wing 151 and an elastic element 17 disposed between the two wings 151 of the support pillar 15.

In this preferred embodiment, the top support element 21 is substantially in a disc-shape and installed in the containing portion 13 of the seat body 11, and the top support element 21 has two openings 22 formed at positions corresponding to the two wings 151 of the support pillar 15 for passing the wings 151 respectively, and an end of the elastic element 17 presses against the containing portion 13, and the other end presses against the top support element 21.

The cover 31 includes a second insert portion 32 corresponding to each of the first insert portion 14 of the seat body 11, and the cover 31 is coupled to each of the first insert portions 14 by each of the respective second insert portion 32 to combine with the seat body 11, and the cover 31 further includes a through hole 33 communicated with the containing portion 13, and an electrically conductive plate 34 installed in the through hole 33 and electrically coupled to the terminal 52 of the lamp tube 51.

The rotating element 41 includes a panel portion 42 and an axle portion 43 extended in a direction opposite to the panel portion 42, and the panel portion 42 has an embedding groove 44 formed thereon and communicated with both sides of the rotating element 41 for embedding the terminal 52 of the lamp tube 51, a plugging hole 45 formed at a middle-section position of the embedding groove 44 for passing the support pillar 15, wherein the axle portion 43 of the rotating element 41 is passed into the through hole 33 of the cover 31, and the rotating element 41 can be pivotally turned with respect to the cover 31 to an installing position and a conducting position by using the center of the through hole 33 as an axis, so that the terminal 52 of the lamp tube 51 installed in the embedding groove 44 presses against the electrically conductive plate 34 by the pivotally turning to constitute an electrically conducting state, and the top support element 21 disposed in the containing portion 13 of the seat body 11 is elastically pressed by the elastic element 17 to abut the rotating element 41, and a positioning portion 46 is disposed on both sides of the inner periphery of the plugging hole 45 separately and opposite to the stop portion 16 of the support pillar 15, and an oblique guide plane 47 is formed on both sides of each of the positioning portion 46 separately and coupled to the positioning portion 46.

Figure 4:
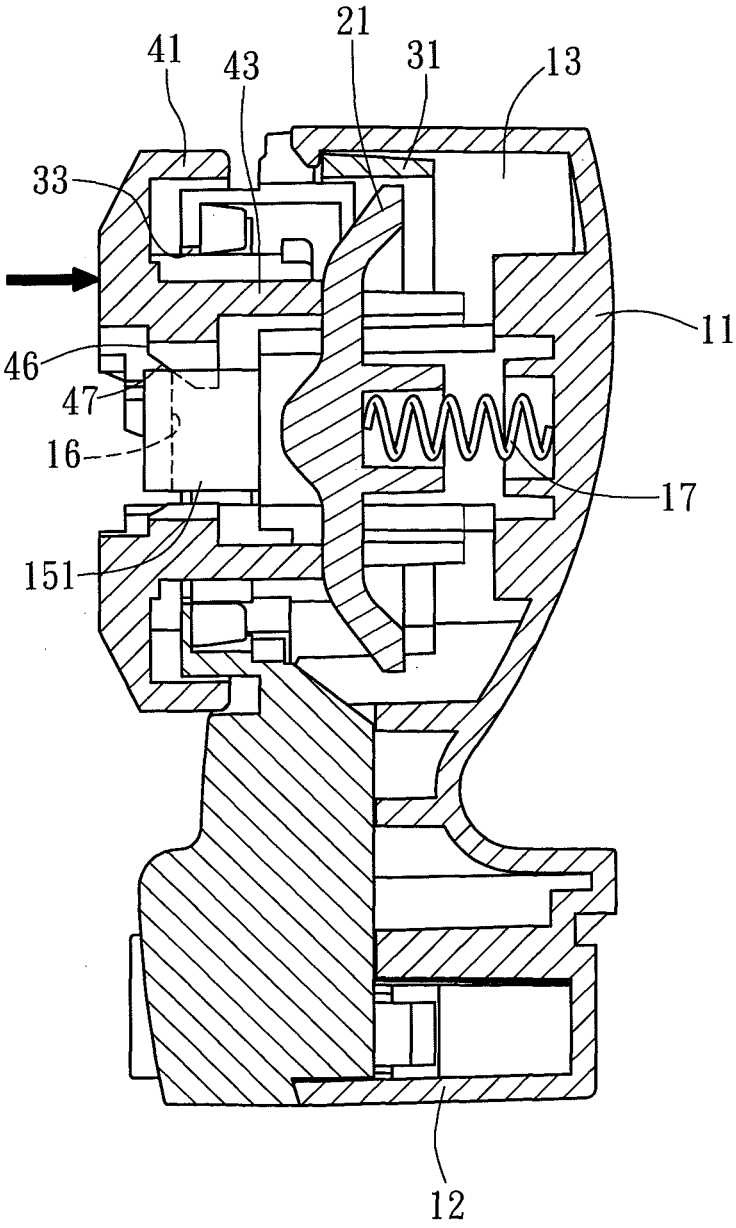
FIG. 4 is a schematic view showing the action of a rotating element of the present invention.

With the aforementioned assembly of the present invention, when the seat body 11 and its support pillar 15 remain fixed (or when the lamp tube socket of the present invention is installed onto the lamp tube base 61), and the rotating element 41 is pivotally turned to the installing position as shown in FIG. 4, the oblique guide plane 47 of the rotating element 41 is limited by the stop portion 16 of the support pillar 15 to force the rotating element 41 to gradually retract on the oblique guide plane 47 towards the cover 31 to compress the elastic element 17, and when the rotating element 41 is pivotally turned to the installing position, the positioning portion 46 of the rotating element 41 and the stop portion 16 of the support pillar 15 are latched with each other to position the rotating element 41.

On the other hand, when the rotating element 41 is pivotally turned to the conducting position, the latch between the positioning portion 46 and the stop portion 16 is released, and the elastic resilience of the elastic element 17 drives the rotating element 41 to be pressed by the elastic element 17 to protrude to the outside.

Figure 5:
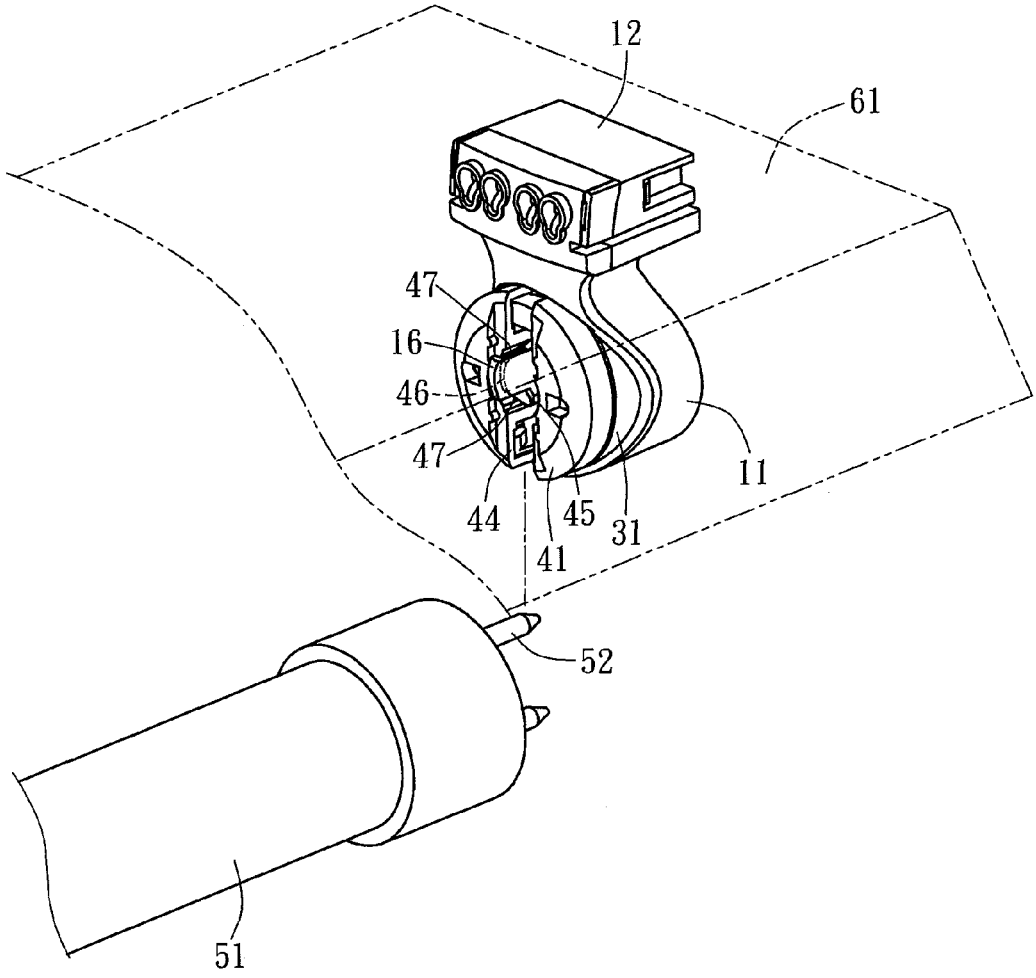
FIG. 5 is a schematic view showing an assembling status of the present invention.
Figure 6:
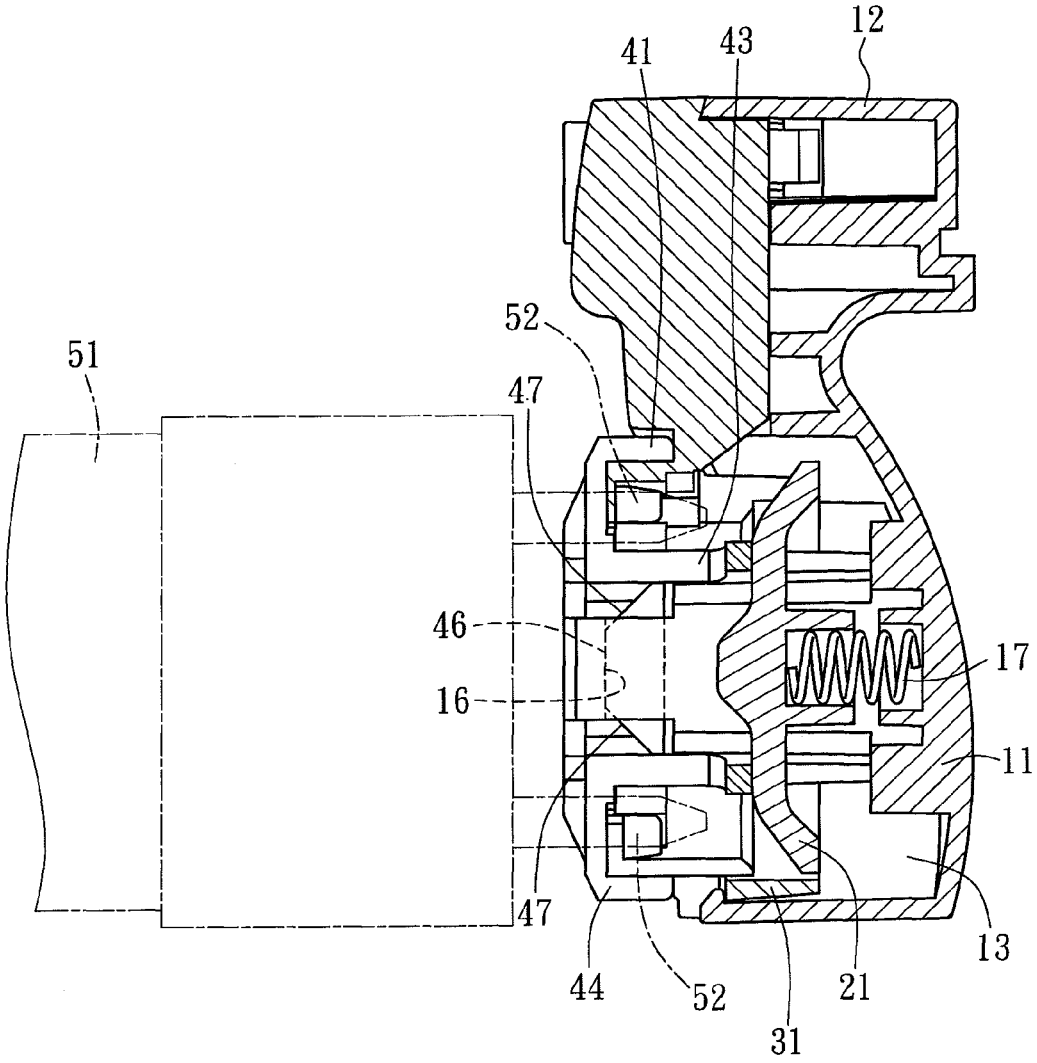
FIG. 6 is a schematic view of a using status of the present invention, showing a lamp tube terminal embedded into a rotating element.

In a practical use of the present invention, the rotating element 41 is pivotally turned to the installing position as shown in FIG. 4, and the oblique guide plane 47 of the rotating element 41 is limited by the stop portion 16 of the support pillar 15 to force the rotating element 41 to gradually retract towards the cover 31 to compress the elastic element 17. When the positioning portion 46 of the rotating element 41 and the stop portion 16 of the support pillar 15 are latched with each other, the rotating element 41 is situated in a state of retracting towards the cover 31 to compress the elastic element 17, users can embed the terminal of the lamp tube 51 into the embedding groove 44 of the rotating element 41 directly without the need of pressing the rotating element 41 as shown in FIGS. 5 and 6, so as to provide a quick, simple and easy installation of the lamp tube 51.

Figure 7:
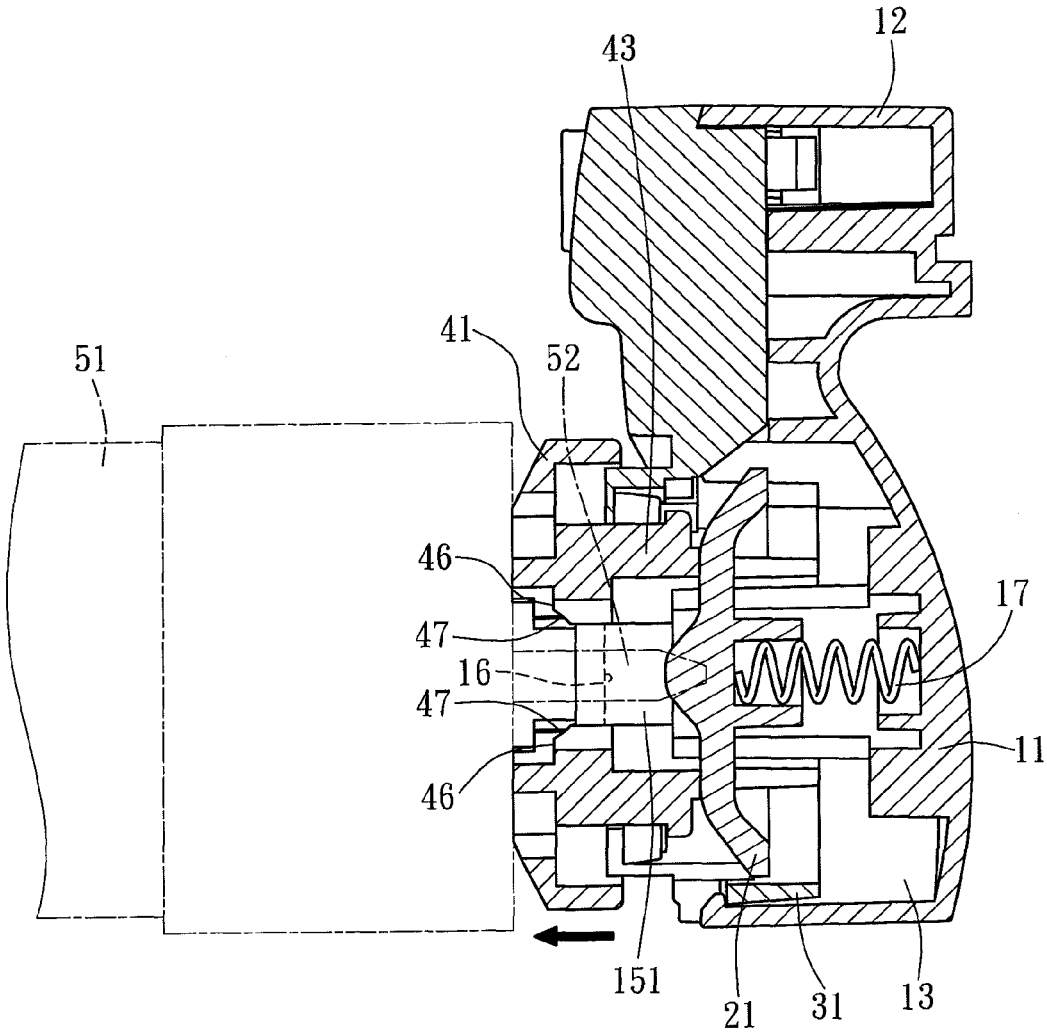
FIG. 7 is a schematic view of a using status of the present invention, showing a rotating element pivotally coupled to a conducting position.
Figure 8:
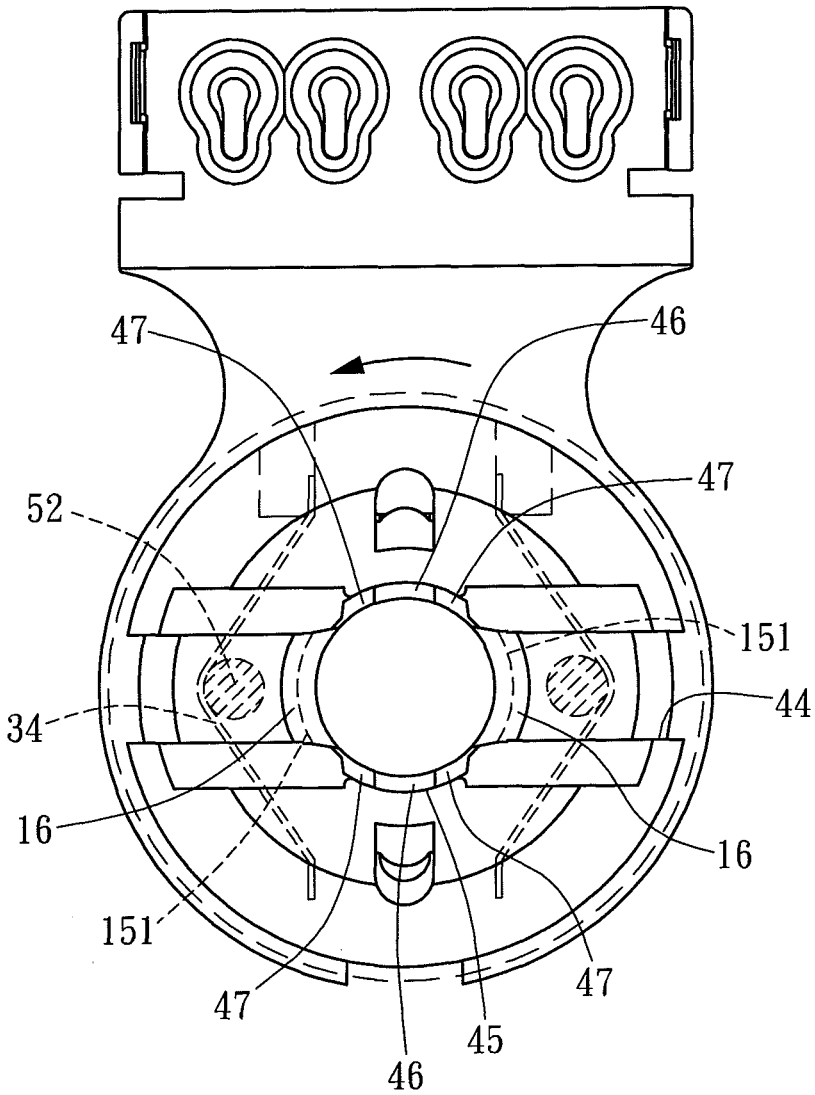
FIG. 8 is a schematic view of a using status of the present invention, showing a rotating element pivotally coupled to a conducting position to electrically conduct a lamp tube terminal and an electrically conductive plate with each other.
Figure 9:
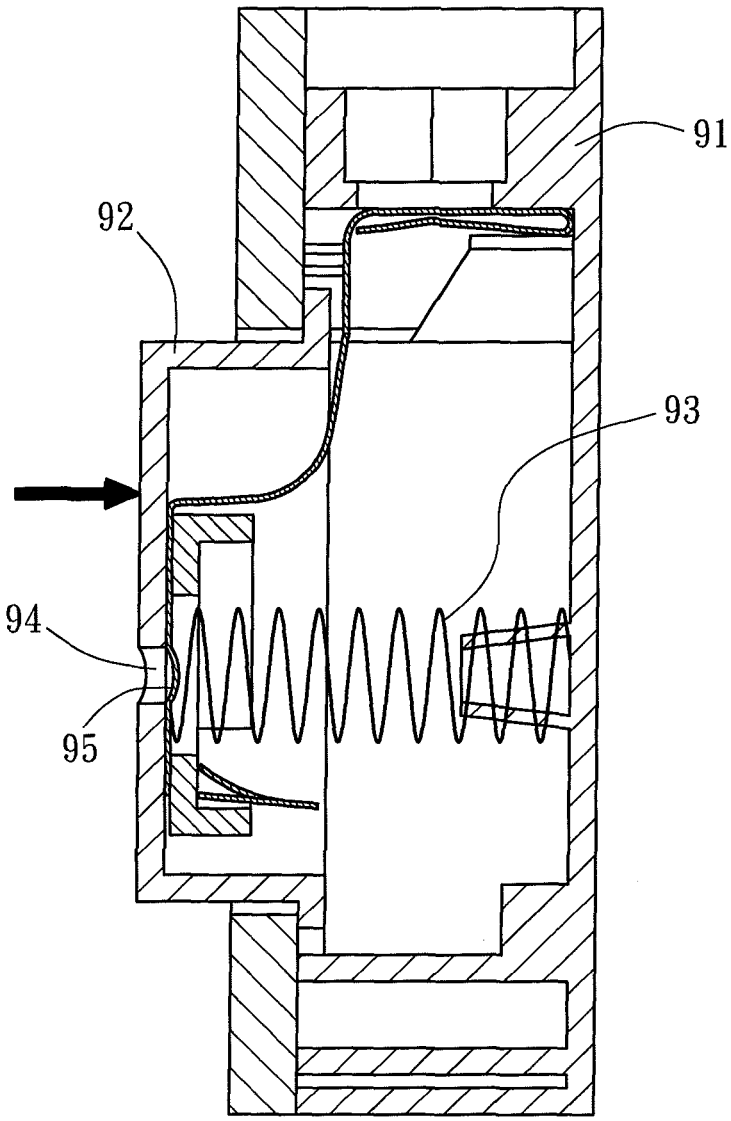
FIG. 9 PRIOR ART
FIG. 9 is a schematic view of the structure of a conventional lamp tube socket.

When the user turns the lamp tube 51 that is embedded into the embedding groove 44, the terminal 52 drives the rotating element 41 to turn 90 degrees to the conducting position as shown in FIG. 7. When the rotating element 41 is pivotally turned to the conducting position the latch state between the positioning portion 46 and the stop portion 16 is released, so that the terminal 52 of the lamp tube 51 and the electrically conductive plate 34 in the through hole 33 are presses against each other to form an electric conduction (as shown in FIG. 8), and the elastic resilience of the elastic element 17 drives the rotating element 41 pressed by the elastic element 17 to protrude to the outside. Now, an end of the lamp tube 51 is propped by the outward popping force of the rotating element 41 and pushed to achieve the effect of clamping the lamp tube 51 in a fixed position, and the lamp tube 51 is turned to the conducting position to assure the fixing effect and prevent the lamp tube 51 from falling out.

What is claimed is:

1. A rotating lamp tube socket structure, comprising:

a seat body, having an installing portion and a containing portion, and the containing portion having a support pillar, and at least one stop portion formed at a top end of the support pillar and protruded outwardly;

a cover, covered onto the containing portion of the seat body, and having a through hole formed on the cover and communicated with the containing portion, and an electrically conductive plate installed in the through hole;

a rotating element, passed into the through hole of the cover, and pivotally turnable with respect to the cover to an installing position and a conducting position, and having an elastic element installed in the containing portion of the seat body and capable of pushing the rotating element outward, an embedding groove penetrating through both sides of the rotating element and provided for embedding a lamp tube terminal therein, a plugging hole formed in the embedding groove and provided for passing the support pillar, a positioning portion disposed on an inner periphery of the plugging hole and opposite to the stop portion of the support pillar, and an oblique guide plane formed on both sides of the positioning portion separately and coupled to the positioning portion;

wherein, during the process of pivotally turning the rotating element to the installing position, the oblique guide plane of the rotating element is limited by the stop portion of the support pillar to force the rotating element to retract in a direction towards the cover gradually and compress the elastic element, and when the rotating element is pivotally turned to the installing position, the positioning portion of the rotating element and the stop portion of the support pillar are latched with each other to position the rotating element; and when the rotating element is pivotally turned to the conducting position, the latch between the positioning portion and the stop portion is released, and an elastic resilience of the elastic element drives the rotating element propped by the elastic element to be protruded to the outside.

2. The rotating lamp tube socket structure of claim 1, wherein the seat body includes at least one first insert portion, and the cover has a second insert portion corresponding to the first insert portion of the seat body, and the cover is coupled to the first insert portion by the second insert portion to combine with the seat body.

3. The rotating lamp tube socket structure of claim 1, further comprising a top support element disposed between the elastic element and the rotating element, and an end of the elastic element abuts the containing portion, and the other end abuts the top support element, so that the top support element is elastically pressed by the elastic element to about the rotating element.

4. The rotating lamp tube socket structure of claim 3, wherein the support pillar is formed by two wings installed opposite to each other, and each of the wings has a stop portion outwardly protruded from a top end of each wing, and the elastic element is disposed between the two wings, and the top support element has two openings corresponding to the wings for passing the wings respectively.

5. The rotating lamp tube socket structure of claim 4, wherein the plugging hole includes a positioning portion disposed on both sides of the internal periphery of the plugging hole separately and opposite to the stop portion of the support pillar.

6. The rotating lamp tube socket structure of claim 1, wherein the rotating element includes a panel portion and an axle portion extended towards a direction opposite to the panel portion, and the rotating element and the axle portion of the rotating element are passed through the through hole of the cover, so that the rotating element is pivotally turnable with respect to the cover by using the center of the through hole as an axis.

7. The rotating lamp tube socket structure of claim 1, wherein when the rotating element is pivotally turned to the conducting position, the lamp tube terminal embedded into the embedding groove is coupled to the electrically conductive plate in the through hole to form an electric conduction.

* * * * *